United States Patent [19]

Gotoh

[11] 3,967,656

[45] July 6, 1976

[54] METHOD OF AND DEVICE FOR CONTROLLING A WEAVING LOOM

[75] Inventor: Miyuki Gotoh, Tokorozawa, Japan

[73] Assignee: Nissan Motor Co., Ltd., Japan

[22] Filed: Feb. 25, 1975

[21] Appl. No.: 553,032

[30] Foreign Application Priority Data

Mar. 7, 1974 Japan ..... 49-26622
May 20, 1974 Japan ..... 49-56408

[52] U.S. Cl. ..... 139/370.2; 66/157
[51] Int. Cl.[2] ..... D03D 51/38
[58] Field of Search ..... 139/336, 348, 370 A, 139/370 R, 370.1, 370.2; 66/157, 166; 340/259, 419

[56] References Cited

UNITED STATES PATENTS

| | | | |
|---|---|---|---|
| 3,409,779 | 11/1968 | Fertig | 66/166 |
| 3,495,633 | 2/1970 | Sakamoto et al. | 139/370 |
| 3,613,743 | 10/1971 | Sakamoto | 139/336 |
| 3,744,533 | 7/1973 | Yano et al. | 139/370 |
| 3,790,761 | 2/1974 | Crabtree | 66/157 |

*Primary Examiner*—Henry S. Jaudon
*Attorney, Agent, or Firm*—Robert E. Burns; Emmanuel J. Lobato; Bruce L. Adams

[57] ABSTRACT

Herein disclosed is a method of and a device for controlling a weft inserting motion of an automatic weaving loom so that the loom is brought to a stop in the event a weft yarn has failed to be properly picked into a shed of warp yarns a predetermined number of times within a predetermined time interval which corresponds to a predetermined unit length of a fabric produced.

13 Claims, 9 Drawing Figures

METHOD OF AND DEVICE FOR CONTROLLING A WEAVING LOOM

BACKGROUND OF THE INVENTION

The present invention relates in general to an automatic weaving loom for producing a woven fabric and particularly to a weft inserting or filling motion to be incorporated into an automatic weaving loom for cyclically shooting or picking a weft yarn into a shed formed between a pair of angularly spaced sets of warp yarns for continuously producing a woven fabric. More specifically, the present invention is concerned with a method of controlling the weft inserting motion of an automatic weaving loom for the purpose of stopping the loom in the event of a failure invited in the loom or, more specifically, in case the weft inserting motion of the loom fails to shoot the weft yarn into the shed of the warp yarns to a length covering the overall width of the shed during operation of the loom. The present invention is further concerned with a control device which is adapted to put such a method into practice in a usual weft inserting motion of an automatic weaving loom.

Failure of picking a weft yarn throughout the width of a shed of warp yarns results in production of defects in a woven fabric and, for this reason, the weft inserting motion incorporated in an automatic weaving loom is usually furnished with a control device which is adapted to detect a shortage of the length of a weft yarn picked into the shed in each of weft inserting cycles and to bring the loom to a stop in the event the weft yarn picked into the shed is short of a predetermined length covering the overall width of the shed of the warp yarns. Such a control device uses mechanical, electrical or, in some cases, an electro-mechanical detecting means responsive to the reach of the pick of a weft yarn to the widthwise foremost end of the shed. None of such detecting means has proved entirely acceptable because they are apt to erroneously respond to the picking motions and thus fail to offer satisfactory reliability of operation. The conventional detecting means may be erroneously actuated to stop the loom even though the weft yarn is picked throughout the width of the shed of the warp yarns and has properly reached the widthwise foremost end of the shed. Or otherwise, the prior art detecting means may happen to fail to detect a pick of the weft yarn which has undershot the end of the shed. If the loom is thus objectionably brought to a stop in the absence of a failure in the weft inserting motion, then production of a stop-mark will result, imparing the commercial value of the fabric produced. If, on the other hand, the loom is permitted to continue the weaving operation with a failure involved in the weft inserting motion by an oversight of the weft yarn short of the prescribed length, the resultant fabric will have critical defects that will also impair the quality of the fabric.

One of the known control devices for use with the weft inserting motions uses an electric circuitry which comprises a first signal generator for producing pulses corresponding to picking cycles and a second pulse generator for producing pulses representative of the picks of the weft yarn shot through the shed of warp yarns to a proper length. The first pulse generator is connected directly and the second pulse generator connected through a logical negation circuit to input terminals of a logical AND gate circuit so that the AND gate circuit produces an output signal in the presence of the pulse from the first pulse generator and concurrently in the absence of the pulse from the second pulse generator, viz., when the weft yarn picked into the shed of the warp yarns is short of a predetermined length and consequently fails to reach the widthwise foremost end of the shed. The loom is temporarily shut down in response to the output signal from the AND gate circuit and is started for a second time when the failure involved in the weft inserting mechanism is removed or remedied.

The prior art control device of this nature is thus operative to detect the weft picking condition in each of the picking cycles of the loom and to stop the loom each time the weft yarn fails to be properly shot into the shed of warp yarns. The output signals delivered from the logical AND gate circuit will therefore contain a signal which is produced by the erroneous actuation of the detecting means. Stopping the loom by such an erroneous actuation of the detecting means will not only result in the formation of a stop-mark in the resultant fabric as previously pointed out but in deterioration of the production efficiency because of the downtime caused by the unnecessary stoppage of the loom. If, however, arrangement is made so that the signals delivered from the control circuitry are monitored with a view to reducing the frequency at which the loom is to be stopped, the quality of the resultant fabric will be improved and at the same time the production efficiency of the loom will be significantly increased. In view of the fact that a fabric is regarded as acceptable on the part of the manufacturer if the fabric contains defects less than a certain number per a certain length of the fabric, the signals delivered from the control circuitry may be monitored in such a manner that the loom is brought to a stop if, and only if, the number of the output signals from the control circuit has exceeded a predetermined number when the fabric is produced a predetermined length. The present invention has been completed on the basis of such a discovery.

SUMMARY OF THE INVENTION

It is, accordingly, an important object of the present invention to provide an improved method of controlling the weft inserting motion of an automatic weaving loom in such a manner as to stop the loom in the event the weft yarn has failed to be picked into the shed of warp yarns to a proper length a predetermined number of times per a predetermined unit length of the weft yarn.

It is another important object of the present invention to provide a control device to carry such a method into practice in a simple and economical construction which is ready to be incorporated into the existing automatic weaving loom.

When the loom which has been temporarily shut down due to the failure involved in the weft inserting motion is started up for a second time, the loom or more specifically the weft inserting motion tends to fail to properly operate more frequently than usual, viz., than before the failure leading to the stoppage of the loom was invited. If, for example, the loom is stopped because of the weft yarn having failed to be shot to a proper length due to formation of fluff thereon, there sometimes happens that the yarn is susceptible to tension and easily breaks up unless the fluff is completely remedied or if the yarn is locally reduced or thinned as a result of the fluff remedied. If, on the other hand, the loom is re-started with the failure left involved in the weft inserting motion for the purpose of accurately troubleshooting the loom, the weft yarn would repeatedly fail to be properly picked into the shed and produce an increased number of defects in the resultant fabric. It is, for this reason, preferable that the loom be stopped for a second time in response to the first pick of the weft yarn failing to be properly shot into the shed, viz., to the first signal produced from the control circuit of the nature previously described.

It is, thus, still another object of the present invention to provide a method of and a device for controlling the weft inserting motion of an automatic weaving loom in such a manner that the loom is brought to a stop not only if the weft yarn has failed to be properly picked into the shed of the warp yarns a predetermined number of times per a predetermined unit length of the fabric produced but in response to the first pick of the weft yarn failing to be properly shot into the shed of the warp yarns after the loom is re-started from a downtime condition during which the weft inserting motion of the loom has been trouble-shooted and remedied for removal of the failure created in the weft inserting motion during the preceding operation of the loom.

In accordance with one important aspect of the present invention, there will be provided a method of controlling a weft inserting motion of a weaving loom for stopping the loom in the presence of failure in the weft inserting motion, comprising monitoring the weaving rate of the loom for producing a train of first signals at substantially equal time intervals each representative of a predetermined unit length of a fabric produced, monitoring picks of a weft yarn shot into a shed of warp yarns for producing a second signal responsive to a pick of the weft yarn improperly shot into the shed, storing the second signals produced, and producing a control signal responsive to a predetermined number of the second signals produced within a time interval between consecutive two of the first signals for thereby stopping the loom in response to the control signal. If preferred, the method according to the present invention may further comprise clearing the stored second signals if the stored second signals are short of the predetermined number. In this instance, the method according to the present invention may still further comprise producing and storing a predetermined number of third signals after the stored second signals are cleared off and prior to re-starting of the loom, the predetermined number of the third signals being smaller, preferably by one, than the predetermined number of the second signals with which the control signal is to be produced in the time interval between consecutive two of the first signals, and producing the control signal in response to the second signal firstly produced during subsequent operation of the loom which is re-started.

In accordance with another important aspect of the present invention, there will be provided a device which comprises first monitoring means for monitoring the weaving rate of the loom for producing a train of pulses at substantially equal time intervals each representative of a predetermined unit length of a fabric produced, second monitoring means for monitoring picks of a weft yarn into a shed of warp yarns for producing a signal responsive to a pick of the weft yarn improperly shot into the shed, a control circuitry to be supplied with the pulses from the first monitoring means and the signals from the second monitoring means for storing therein the signals from the second monitoring means and producing a control signal responsive to a predetermined number of second control signals stored within a time interval between consecutive two of the pulses from the first monitoring means, and means for stopping the loom in response to the control signal produced by the control circuitry. The control circuitry is preferably so arranged as to be re-set by the pulse produced by the first monitoring means at the end of the time interval between consecutive two of the pulses from the first monitoring means if the signals stored in the control circuitry are short of the predetermined number.

The first monitoring means may be arranged in such a manner as to detect the travelling speed of the woven fabric from the fell of the fabric or the rate at which the weft yarn is drawn off from a yarn supply source. On the other hand, the second monitoring means may be so arranged as to detect a pick of the weft yarn which has failed to reach a predetermined target or which is left slackened even though the yarn has been shot into the shed.

BRIEF DESCRIPTION OF THE DRAWINGS

Other features and advantages of the method and the device according to the present invention will become apparent from the following description taken in conjunction with the accompanying drawings, in which.

DESCRIPTION OF THE PREFERRED EMBODIMENTS

Figure 1:
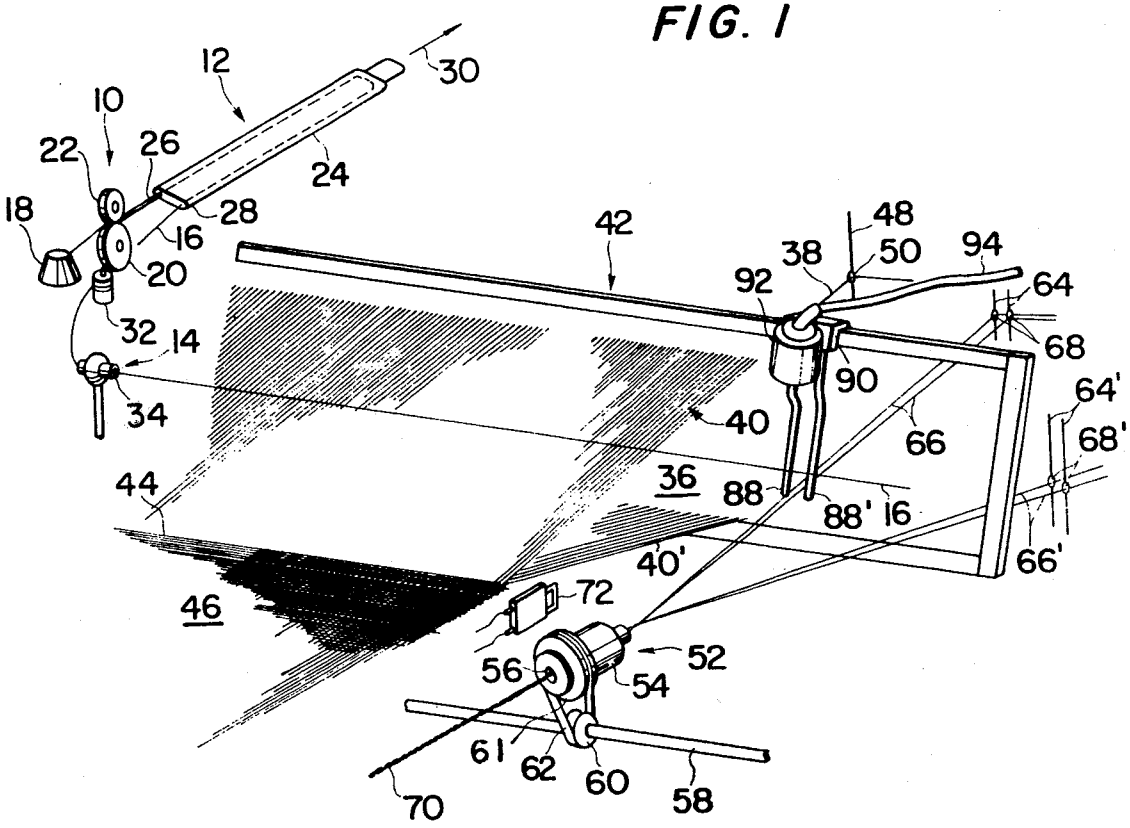
FIG. 1 is a perspective view showing essential parts and structures of a weft inserting motion of an automatic weaving loom incorporating a first preferred embodiment of the control device according to the present invention.

In the figures of the drawings, like reference numerals designate corresponding parts, members, structures and circuits. In each of the figures showing mechanical constructions of looms, moreover, conventional parts and units making up the loom have been removed for the same of simplicity of illustration and because of the fact that such parts and units are immaterial for the understanding of the features and advantages of the control device embodying the present invention.

The automatic weaving loom to incorporate each of the embodiments according to the present invention will be herein described and shown as being of the shuttleless or jet type which uses a jet of air for shooting the weft yarn into the shed of the warp yarns as is well known in the art of textile production. This is, however, merely for the purpose of illustration and, accordingly, the control device embodying the present invention may be incorporated into an automatic weaving loom using shuttles in the weft inserting motion thereof.

Referring to the drawings, first particularly to FIG. 1, the weft inserting motion of an automatic weaving loom is shown, on the left-hand side of the drawing, as comprising yarn drawing and measuring means 10, yarn detaining means 12, and yarn shooting means 14. The yarn drawing and measuring means 10 is adapted to cyclically draw off a weft yarn 16 from a yarn supply package 18 such as a cone as illustrated and measures the yarn 16 to a predetermined length. The yarn drawing and measuring means 10 is shown, by way of example, as consisting of a measuring roller 20 which is driven for rotation about a horizontal axis at a speed matched with an operating speed of the weaving loom as a whole and a yarn retaining roller 22 which is arranged to be cyclically brought into rolling contact with the measuring roller and which is thus driven for rotation about its axis in a direction opposite to the direction of rotation of the measuring roller 20. The weft yarn 16 leading from the yarn supply package 18 is passed between the measuring and retaining rollers 20 and 22 and is drawn off to a predetermined length with the retaining roller 22 held in rolling contact with the measuring roller 20 for a predetermined period of time. The cyclic movement of the retaining roller 22 into and out of rolling contact with the measuring roller 20 is effected by suitable driving means which is controlled in accordance with prescribed schedules by, for example, a pattern card arrangement (not shown) as is customary in the art. On the other hand, the yarn detaining means 12 is shown to comprise, also by way of example, a hollow elongate yarn detaining tube 24 which is longitudinally positioned in parallel to the path of the weft yarn 16 travelling forwardly from between the measuring and retaining rollers 20 and 22. The yarn retaining tube 24 has formed at its end close to the delivering side of the yarn drawing and measuring means 10 a yarn inlet passage 26 aligned with the path of the weft yarn 16 from the yarn drawing and measuring means 10 and a yarn outlet opening 28 located in proximity to the end of the yarn inlet passage 26. A stream of air is constantly established in the hollow yarn detaining tube 24 in the direction of arrow 30, viz., from the delivery side of the yarn drawing and measuring means 10 forward so that the yarn 16 entering the yarn detaining tube 24 is biased forwardly in the tube 24. The length of the weft yarn 16 drawn and measured off by the yarn drawing and measuring means 10 is admitted into the yarn detaining tube 24 through the yarn inlet passage 26 and is temporarily stored within the tube 24 in a generally hair-pin form as indicated by a broken line by virtue of the suction of air induced in the tube 24, having its intermediate or central portion located at the foremost end of the tube 24 and its leading end emerging from the yarn outlet opening 28. The weft yarn 16 leading from the length stored in the detaining tube 24 is passed via an idle roller 32 to the yarn shooting means 14. The yarn shooting means 14 is shown, by way of example, as consisting of a nozzle 34 through which the yarn 16 is entrained on a jet of fluid and shot into a shed 36 formed between a pair of angularly spaced sets of warp yarns 38, the two sets of warp yarns being indicated by reference numerals 40 and 40'.

The loom has a weaving unit which comprises, as is customary in the art, a reed 42 constituted by a comb-like arrangement of flattened steel wires or dents through not shown and positioned in parallel to the shed 36 of the warp yarns. The reed 42 is movable toward and away from the fell 44 of a woven fabric 46 so that a pick of the weft yarn 16 which has been shot through the shed 36 of the warp yarns is beaten up onto the fell 44 of the fabric 46 in each of the weaving cycles which are subsequent to picking cycles. The two sets 40 and 40' of warp yarns 38 are alternately raised and lowered for forming the shed 36 by means of a number of healds 48 each passing a single warp yarn 38 through its eye 50, although only one of the healds 48 is shown in FIG. 1 to avoid complexity of illustration. The loom further comprises a weft retaining arrangement for retaining the pick of the weft yarn 16 which has reached to widthwise foremost end (viz., the rightmost end) of the shed 36 of the warp yarns 38. The weft retaining arrangement is shown, by way of example, to comprise a twisting mechanism 52 located alongside the widthwise end of the woven fabric 46 which corresponds to the above mentioned widthwise foremost end of the shed 36. The twisting mechanism 52 consists of a rotor 54 which is rotatable about an axis substantially parallel to the direction of travel of the woven fabric 46 and which is formed with an axial bore or passageway 56 which is open at its ends. The rotor 54 is driven for rotation about its axis from an external driving source (not shown) through, for example, a belt and sheave arrangement and a shaft 58 which is shown to extend in parallel to the shed 36 of the warp yarns 38 and which is driven to rotate about its axis by the external driving source. The belt and sheave arrangement is shown as comprising a grooved driving sheave 60 rotatable with the shaft 58, a grooved driven sheave 61 rotatable with the rotor 54, and an endless quarter-turn belting 62 passed on the driving and driven sheaves 60 and 61 the respective axes of rotation are at right angles to each other. The rotor 54 is thus kept driven for rotation about its axis or its axial bore 56 when the loom is in operation. The weft retaining arrangement further comprises a pair of sets of healds 64 and 64' which are arranged similarly to the healds 48 for the warp yarns 38 and which are driven to move up and down in synchronism with the healds 48. A set of weft retaining yarns 66 are passed through eyes 68 of the healds 64 and likewise a set of weft retaining yarns 66' are passed through eyes 68' of the healds 64'. The two sets of weft retaining yarns 66 and 66' are, thus, alternately raised and lowered by the healds 64 and 64' concurrently as the two sets 40 and 40' of warp yarns 38 are alternately raised and lowered by means of the healds 48 of the weaving unit. The two sets of weft retaining yarns 66 and 66' are passed through the axial bore 56 in the rotor 52 of the twisting mechanism 52 and are thereby twisted on each other into a single line 70. The single line 70 thus formed downstream of the twisting mechanism 52 is drawn off at the same speed as the speed at which the woven fabric 46 is advanced away from the weaving unit. The weft yarn 16 shot from the nozzle 34 of the weft shooting means 14 is received between the two sets of weft retaining yarns 66 and 66' being fed and drawn off past the reed 42 and is entwined at its foremost free end with the two sets of weft retaining yarns 66 and 66' which are on the point of being twisted around each other in the vicinity of the widthwise end of the fell 44 of the woven fabric 46. The weft yarn 16 which has been shot through the shed 36 of the warp yarns 38 to a proper length reaching the weft retaining yarns 66 and 66'. The weft yarn 16 beaten up against the fell 44 of the fabric 46 by the reed 42 and woven with the warp yarns 38 is cut at the selvage of the woven fabric 46 by means of a yarn cutting device 72 located adjacent to the widthwise end of the fell 44 of the fabric 46 so that an end portion of the weft yarn 16 projecting from the selvage of the fabric 46 is removed. The yarn cutting device 72 is herein assumed to be of the type using an electrically energized heat-cutter element although any other form of cutting means may be utilized.

Figure 2:
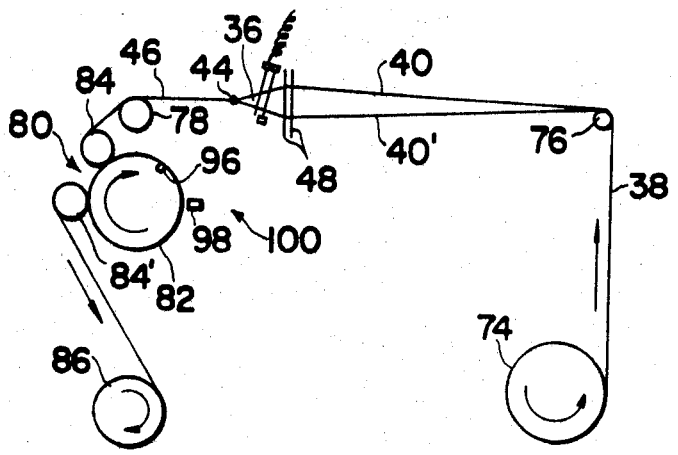
FIG. 2 is a schematic side elevational view of an example of a take-up arrangement of the weaving loom incorporating the weft inserting motion illustrated in FIG. 1.

Turning to FIG. 2, the warp yarns 38 are continuously fed from a warp beam 74 which is driven for rotation about its axis at a speed matched with the operating speed of the loom. The warp yarns 38 are fed from the warp beam 74 by the tension applied to the woven fabric 46 and are passed to the healds 48 via guiding roller 76 which is usually positioned on the same horizontal plane on which the woven fabric 46 is advanced from the fell 44 of the fabric 46. The woven fabric 46 is passed through a breast beam 78 to weaving density control means which is generally designated by reference numeral 80. The density control means 80 is shown to comprise a friction roller 82 rotatable about a horizontal axis and a pair of spaced parallel pressing rollers 84 and 84' which are held in rolling contact with the friction roller 82. The friction roller 82 is driven to rotate clockwise of FIG. 2 at a speed that will provide a prescribed travelling speed of the woven fabric 46 and accordingly of the warp yarns 38 fed from the warp beam 74 so that the picks of the weft yarn 16 are woven with the warp yarns 38 to a predetermined density. The fabric 46 leaving the pressing roller 84' is wound on a cloth roller 86 which serves as a take-up device in the weaving loom.

The first preferred embodiment of the control device according to the present invention applied to the automatic weaving loom thus constructed and arranged comprise first detecting means for monitoring the picks of the weft yarn 16 through the shed 36 of the warp yarns 38, second detecting means for monitoring the weaving rate of the loom, and third detecting means responsive to the operating speed of the loom, viz., to the picking cycles of the weft inserting motion of the loom. Preferred examples of the first, second and third detecting means are illustrated in FIGS. 1, 2 and 3, respectively.

Referring again to FIG. 1, the first detecting means forming part of the first preferred embodiment of the control device according to the present invention is shown to comprise first and second electrodes or electric contact elements 88 and 88' which are positioned in proximity to the widthwise foremost end of the shed 36 of the warp yarns 38, viz., the widthwise end of the shed 36 opposite to the yarn shooting nozzle 34 and which are fixedly mounted on the frame of the reed 42 through a bracket 90 which is shown to be secured to the top cross member of the frame of the reed 42. The first contact element 88 is secured to the bracket 90 through an electrical insulator 92 whereas the second contact element 88' is directly connected to the bracket 90. The bracket 90 and the frame of the reed 42 are constructed by electrically conductive rigid materials and, thus, the second contact element 88' is grounded through the bracket 90, the reed 42 and a frame structure (not shown) of the loom. The first contact element 88 is connected through an electric line 94 to a negative terminal of a d.c. power source which is shown at 114 in FIG. 3. The first and second contact elements 88 and 88' have their lower end portions located substantially in the path of the pick of the weft yarn 16 so that the weft yarn which has been shot throughout the width of the shed 36 of the warp yarns 38 is received with certainty on the front sides of both of the contact elements 88 and 88' before the weft yarn 16 which has thus reached the "shed" between the two sets of weft retaining yarns 66 and 66' is captured by the weft retaining yarns 66 and 66'. When the weft yarn 16 has its free end portion received on the first and second contact elements 88 and 88', the two contact elements 88 and 88' are electrically connected to each other through the portion of the weft yarn 16 received on the contact elements 88 and 88' because of the conductivity possessed by the yarn 16. The pick of the weft yarn 16 received on the contact elements 88 and 88' serves as switch means providing connection between the two contact elements 88 and 88' and is, thus, indicated in the form of a normally open switch 16' in FIG. 3. It is apparent that such a switch 16' closes every time the weft yarn 16 picked into the shed 36 of the warp yarns 38 has successfully reached the first and second contact elements 88 and 88' or, in other words, short to a proper length through the shed 36 of the warp yarns 38.

Referring to FIG. 2, the second detecting means forming part of the first preferred embodiment of the control device according to the present invention comprises an electromagnetic pulse generator which is shown to consist, by way of example, a permanent magnet 96 embedded in the peripheral wall of the friction roller 82 and having an outer face substantially flush with the peripheral surface of the roller 82 and a coil and core arrangement 98 which is positioned in close proximity to and yet at a spacing from the path of the permanent magnet 96 which is rotated about the axis of the friction roller 82 when the friction roller 82 is driven for rotation about the axis. Designated by reference numeral 100 is an output terminal of the coil and core arrangement 98. When the friction roller 82 is driven to rotate about its axis so that the permanent magnet 96 on the peripheral wall of the friction roller 82 is moved closer to the coil and core arrangement 98, a current is produced in the coil and core arrangement 98 by an electromotive force induced therein by the interaction between the magnet and the coil. A current thus appears at the output terminal 100 of the second detecting means every time the friction roller 82 is rotated a full turn so that a train of pulses are delivered from the output terminal 100 of the second detecting means when the friction roller 82 is continuously rotated. It is apparent that the repetition frequency of the pulses produced in this manner is representative of the speed of rotation of the friction roller 82 or, in other words, the rate at which the woven fabric 46 is produced and conveyed away from the weaving unit of the loom. The time interval between every consecutive two of the pulses is, therefore, representative of a predetermined unit length of the woven fabric 46. Such a unit length of the woven fabric 46 is apparently substantially equal to the circumferential length of the friction roller 82. The second detecting means of the first embodiment of the control device according to the present invention is, thus, adapted to monitor the rate at which the woven fabric 46 is produced and drawn off by the take-up device of the loom. The described construction of the second detecting means is merely by way of example and, as such, various forms of such means may be applicable to the first embodiment of the present invention provided such means is capable of producing pulses having a repetition frequency representative of the weaving rate of the loom.

Figure 3:
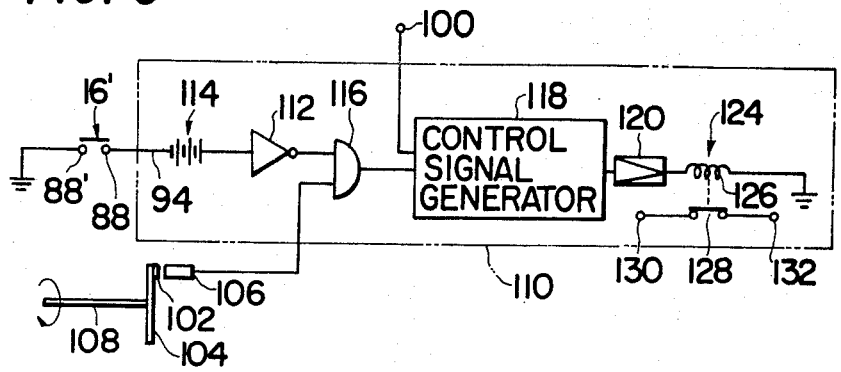
FIG. 3 is a block diagram which shows a preferred example of a control circuit to form part of the first embodiment of the control device according to the present invention.

Referring to FIG. 3, the third detecting means of the first preferred embodiment of the control device according to the present invention is shown to comprise, by way of example, an electromagnetic pulse generator which per se is constructed essentially similarly to the electromagnetic pulse generator constituting the above described second detecting means. Thus, the electromagnetic pulse generator of the third detecting means comprises a permanent magnet 102 fixedly mounted on a rotor 104 and a coil and core arrangement 106 which is located in proximity to the path of the permanent magnet 102. The rotor 104 is carried by a shaft 108 which is driven for rotation about its axis at a speed substantially proportional to or otherwise matched with the operating speed of the loom. When the rotor 102 is thus driven to rotate about the axis of the shaft 108, the third detecting means produces a train of pulses with a repetition frequency representative of the operating speed of the loom, viz., the timings at which the weft yarn is picked into the shed of the warp yarns.

The first, second and third detecting means of the character thus far described have their respective output terminals connected to input terminals of a control circuitry which is designated in its entirety by reference numeral 110 in FIG. 3.

The control circuit 110 shown in FIG. 3 comprises a logical negation circuit 112 having an input terminal connected through a d.c. power source 114 to the switch 16' or, more exactly, to the first contact element 88 forming part of the first detecting means shown in FIG. 1. The negation circuit 112 is preferably constructed as a transistorized operational amplifier and produces a logical 1 output signal when the switch 16' is open (viz., during the intervals between the individual picks of the weft yarn and when the weft yarn shot into the shed has failed to reach the target) and a logical 0 output signal when the switch 16' is closed (viz., when the weft yarn is successfully picked into the shed). The control circuitry 110 further comprises a logical AND gate circuit 116 which has a first input terminal connected to the output terminal of the above mentioned negation circuit 112 and a second input terminal connected to the output terminal of the third detecting means or, more specifically, a terminal end of the coil and core arrangement 106 of the third detecting means. The AND gate circuit 116 is, thus, adapted to produce a logical 1 output signal in the presence of logical 1 signals at both of its input terminals and a logical 0 output signal in the presence of a logical 0 signal at either or both of the input terminals. The AND gate circuit 116 has an output terminal connected to one of two input terminals of a control signal generating circuit 118, the other of the input terminals of the circuit 118 being connected to the output terminal 100 of the previously described second detecting means or, more specifically to the terminal end of the coil and core arrangement 98 shown in FIG. 2. The control signal generating circuit 118 is arranged in such a manner as to count the number of the logical 1 signals delivered thereto from the logical AND gate circuit 116 and to produce an output signal when a predetermined number of logical 1 signals are fed to the circuit 118 during an interval between consecutive two of the pulses fed to the circuit 118 from the output terminal 100 of the second detecting means shown in FIG. 2. When the control signal generating circuit 118 is supplied with the pulse from the second detecting means at the end of the interval, the signal generating circuit 118 is re-set into its initial state so that the logical 1 signals which have been stored or memorized in the circuit 118 during the interval, or cycle, between the particular two pulses from the second detecting means are cleared. The control signal generating circuit 118 has an output terminal which is connected through an amplifier 120 to a relay 124 having a relay coil 126 and normally-closed contacts 128 intervening between terminals 130 and 132. The terminals 130 and 132 may be connected between a driving unit such as a motor for the loom and a power source for the driving unit, though not shown. In this instance, the driving unit for the loom is de-energized to stop the loom when the normally-closed contacts 128 are made open with the relay coil 126 energized by the output signal from the control signal generating circuit 118. Where desired, the terminals 130 and 132 may be connected between an electrically or electromagnetically operated braking unit and a power source for the braking unit. In this instance, the relay 124 should be so arranged as to have normally-open contacts so that the braking unit is energized and actuated to brake the loom when the normally-open contacts are caused to close with the relay coil 126 energized by the signal from the control signal generating circuit 118.

The operation of the control device embodying the present invention will now be described with concurrent reference to FIGS. 1 to 3 and further to FIG. 4 which shows waveforms A to G of the various signals appearing in the control circuitry 110 illustrated in FIG. 3. The waveform A appears at the input terminal of the negation circuit 112 and, thus, has a logical 1 state when the switch 16' is closed. The waveform B is produced by the negation circuit 112 and has a logical 1 state in the absence of a logical 1 signal at the input terminal of the negation circuit 112. The waveform B is, thus, the waveform of the signal appearing at the first input terminal of the logical AND gate circuit 116. The waveform C represents the output signal from the third detecting means shown in FIG. 3 and thus appears at the second input terminal of the logical AND gate circuit 116. The waveform D is representative of the output signal from the logical AND gate circuit 116 and accordingly has a logical 1 state in the absence of logical 1 signals at both of its input terminals. The waveform E is delivered from the output terminal 100 of the second detecting means shown in FIG. 2 and, thus, includes pulses representative of the full turns of the friction roller 82. The waveform F appears at the output terminal of the control signal generating circuit 118. The waveform G is the one which is delivered from the amplifier 120.

During operation of the loom, the weft yarn 16 is cyclically drawn off from the supply package 18 and measured to a predetermined length by means of the measuring and retaining rollers 20 and 22. The length of the weft yarn thus measured off is substantially equal to or appreciably greater than the distance between the yarn shooting nozzle 34 and the weft retaining yarns 66 and 66' so that the leading end portion of the weft yarn picked into the shed 36 of the warp yarns 38 is engageable with the contact elements 88 and 88' of the first detecting means shown in FIG. 1. The measured-off length of the weft yarn 16 is admitted into the yarn detaining tube 24 by the suction of air established in the tube and is temporarily stored in the tube 24 during a weaving cycle in which the length of the weft yarn leading from the stored length of the yarn is being picked into the shed 36 and woven with the warp yarns 38 in the weaving unit of the loom. Upon completion of the preceding picking and weaving cycle, the length of the weft yarn 16 which has been stored in the yarn detaining tube 24 is shot by a jet of fluid from the yarn shooting nozzle 34 into the shed 36 of the warp yarns 38. If, in this instance, the weft yarn 16 is successfully shot beyond the widthwise foremost end of the shed 36, the weft yarn 16 is inserted into the "shed" of the weft retaining yarns 66 and 66' and is simultaneously brought into contact with both of the first and second contact elements 88 and 88' of the first detecting means. The weft yarn 16 is then captured by the two sets of weft retaining yarns 66 and 66' and is beaten up onto the fell 44 of the woven fabric 46 by the reed 42 which is moved forward. During the period of time for which the weft yarn 16 is in contact with the two contact elements 88 and 88' of the first detecting means, the contact elements 88 and 88' are electrically connected to each other through the portion of the weft yarn received on the contact elements 88 and 88' so that the switch 18' shown in FIG. 3 is in a closed condition. The negation circuit 112 is consequently supplied with a current froom the d.c. power source 114 and delivers a logical 0 signal at its output terminal. When the weft yarn 16 is repeatedly picked into the shed 36 of the warp yarns 38 in proper conditions in consecutive weft picking cycles, the negation circuit 112 is supplied with the input signal having the waveform A indicated in the left-hand half of FIG. 4 and delivers the output signal having the waveform B also indicated in the left-hand half of FIG. 4. While the weft yarn 16 is being cyclically picked into the shed 36 of the warp yarns 38 in this manner, the rotor 104 of the second detecting means shown in FIG. 2 is driven by the loom for rotation about the axis of the shaft 108 at a speed proportional to or otherwise matched with the operating speed of the loom. The logical AND gate circuit 116, which is being supplied with the signal having the waveform B indicated in the left-hand half of FIG. 4, is thus also supplied with a train of pulses as indicated by the waveform C in FIG. 4. Although the pulse is fed from the second detecting means to the second input terminal of the logical AND gate circuit 116 in each of the weft picking cycles of the loom, the AND gate circuit 116 continues to deliver a logical 0 signal in the absence of a logical 1 signal at the first input terminal thereof, as will be seen from the waveform D indicated in the left-hand half of FIG. 4. The control signal generating circuit 118 is thus kept supplied with the logical 0 signal from the AND gate circuit while cyclically receiving the pulses having the waveform E from the output terminal 100 of the second detecting means shown in FIG. 2. The signal generating circuit 118 therefore delivers output signal as will be seen from the waveform F shown in FIG. 4 so that the coil 126 of the relay 124 is kept de-energized and, accordingly, the normally-closed contacts 128 of the relay 124 are kept closed maintaining electrical connection between, for example, the driving unit for the loom and the power source for the driving unit.

In the event the weft yarn 16 shot from the yarn shooting nozzle 34 is short of the predetermined length and fails to reach the "shed" between the weft retaining yarns 66 and 66', the weft yarn 16 is unable to contact the first and second contact elements 88 and 88' of the first detecting means shown in FIG. 1 so that the contact elements 88 and 88' are kept electrically disconnected from each other in the weft picking cycle. The negation circuit 112 is, consequently, disconnected from the power source 114 with the switch 16' in open condition and thus delivers a logical 1 signal to the first input terminal of the AND gate circuit 116 simultaneously when a pulse is fed from the third detecting means to the second input terminal of the AND gate circuit 116, as will be seen from the right-hand halves of the waveforms B and C shown in FIG. 4. In the presence of the logical 1 signals at both of the first and second input terminals, the logical AND gate circuit 116 now delivers a logical 1 signal to the control signal generating circuit 118. Even though the weft yarn 16 has failed to be properly picked into the shed 36 in one picking cycle, the weft yarn may be successfully picked in subsequent cycles. If, thus, the signals delivered from the AND gate circuit 116 to the control signal generating circuit 118 are smaller than a predetermined number during a time interval between consecutive two of the pulses which are fed from the output terminal 100 of the second detecting means, then the signals which have been stored or memorized in the signal generating circuit 118 are cleared and accordingly the signal generating circuit 118 is re-set into the initial condition thereof by the pulse which is fed from the second detecting means to the signal generating circuit 118 at the end of the particular time interval. The signal generating circuit 118 is thus ready to count new signals which may be delivered thereto from the AND gate circuit 116 in the subsequent time interval between the next consecutive two of the pulses from the second detecting means. If, however, the weft yarn 16 has repeatedly failed to be properly shot into the shed 36 a predetermined number of times and, as a consequence, the control signal generating circuit 118 is supplied with a corresponding number of logical 1 signals from the AND gate circuit 116 during a time interval between consecutive two of the pulses delivered from the output terminal 100 of the second detecting means shown in FIG. 2, the control signal generating circuit 118 produces an output signal in response to the last one of the predetermined number of signals from the AND gate circuit 116, as indicated by the right-hand half of the waveform F shown in FIG. 4.

Figure 4:
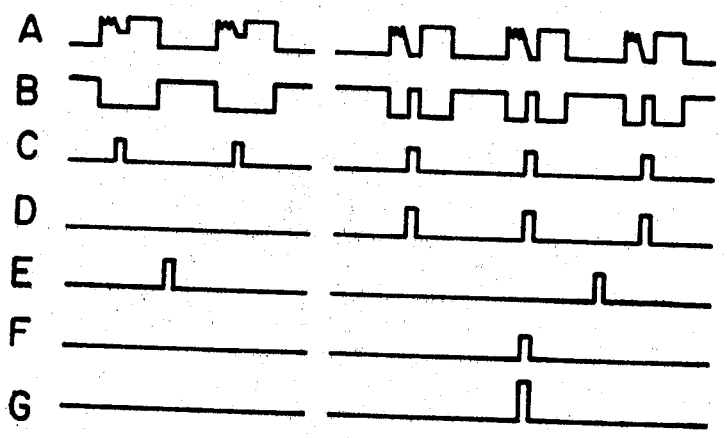
FIG. 4 is a view which shows waveforms produced in the control circuit illustrated in FIG. 3.

The amplifier 120 thus delivers to the relay 124 an output signal having the waveform G in the right-hand half of FIG. 4 so that the coil 126 of the relay 124 is energized and accordingly the normally-closed contacts 128 are made open, disconnecting the driving unit for the loom from the power source. The weaving loom is not brought to a full stop for being trouble shooted in its weft inserting motion.

From the foregoing description it will be understood that the first embodiment of the control device according to the present invention is adapted to stop the weaving loom in the event the weft yarn has failed to be properly shot into the shed of the warp yarns a predetermined number of times during a time interval in which a predetermined length of the woven fabric is produced. If the number of times of the failure of the weft yarn to reach proper target is short of the predetermined number during the time interval in which the woven fabric is produced to the predetermined length, then the signals which have been stored in the control circuit are cleared by the pulse delivered from the second detecting means at the end of the particular time interval.

Figure 6:
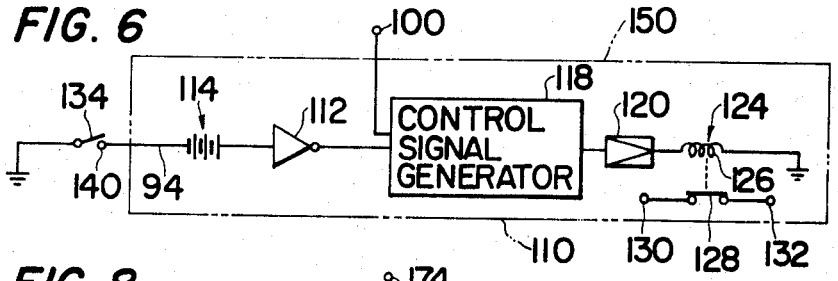
FIG. 6 is a block diagram showing a preferred example of a control circuit which may be incorporated into the second embodiment of the control device according to the present invention.
Figure 5:
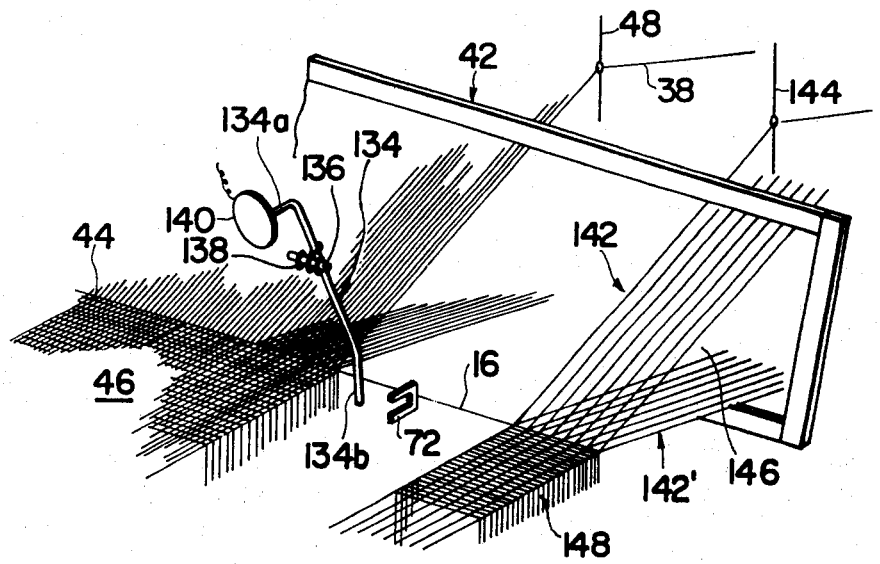
FIG. 5 is a perspective view showing essential parts and structures of a weft inserting motion of an automatic weaving loom incorporating a second preferred embodiment of the control device according to the present invention.

FIGS. 5 and 6 illustrate a second preferred embodiment of the control device according to the present invention. The embodiment herein shown is, in effect, essentially similar to the first embodiment illustrated in FIGS. 1 to 3 but differs from the first embodiment in the arrangement of the first detecting means responsive to improper picks of the weft yarn and in that the second detecting means monitoring the picking cycles of the loom is dispensed with. Referring to FIG. 5, the first detecting means of the second embodiment of the control device according to the present invention comprises a first electrode or contact element 134 of a rod form having a bent or curved upper end portion 134*a*. The first contact element 134 is rotatably mounted at its intermediate portion on a stationary shaft 136 extending over the fell 44 of the woven fabric 46 and substantially in parallel with the shed 36 of the warp yarns 38. The first contact element 134 is rotatable about an axis of the shaft 136 in a plane parallel to the direction of travel of the warp yarns 38 and the woven fabric 46 and is biased to rotate counter-clockwise when viewed from the right-hand side of FIG. 5, viz., in a direction to have its upper portion turned forwardly or in the direction of travel of the woven fabric 46, by suitable resilient biasing means such as for example a preload torsion spring 138 which is anchored at one end to the shaft 136 and which is in pressing engagement with the contact element 134. The contact element 134 further has a lower end portion 134*b* which extends downwardly below a plane on which the fell 44 of the woven fabric 46 is situated. The first contact element 134 is so positioned relative to the weaving unit of the loom that the lower end portion 134*b* of the contact element 134 is engageable at its rear end with the foremost end portion of the weft yarn 16 which has been shot through the shed 36 of the warp yarns 38 to a predetermined length and which has been beaten up onto the fell 44 of the woven fabric 46 by the reed 42 as shown. In the vicinity of the upper end portion 134*a* of the first contact element 134 is fixedly positioned a second electrode or contact element 140 of a generally plate form. The upper end portion 134*a* of the first contact element 134 is configured or bent and, at the same time, the second contact element 140 is located relative to the first contact element 134 in such a manner that the first contact element 134 is brought into abutting engagement at the leading end of the bent portion 134*a* with the rear face of the second contact element 140 when the first contact element 134 is rotated about the axis of the shaft 136 by the biasing force of the torsion spring 138. The first contact element 134 is moved out of engagement with the second contact element against the opposing force of the torsion spring 138 by the weft yarn which is moved or beaten up onto the fell 44 of the woven fabric 46 by the reed 42. The first contact element 134 is, thus, rotatable about the axis of the shaft 136 between a first angular position having its upper end in abutting engagement with the second contact element 140 by the action of the torsion spring 138 and a second angular position in which the upper end of the first contact element 134 is disengaged or spaced apart rearwardly from the second contact element 140 and in which the lower end portion 134*b* of the first contact element 134 is engaged and forced forward by the weft yarn 16 which is moved onto the fell 44 of the woven fabric 46. The first contact element 134 is grounded through the shaft 136 and the structural member of the loom frame whereas the second contact element 140 is connected to the negative terminal of a d.c. power source which is designated by reference numeral 114 in FIG. 6. Electrical connection is thus provided between the first and second contact elements 134 and 140 when the first contact element 134 is rotated into its first angular position contacting the second contact element 140. The first and second contact elements 134 and 140 of the first detecting means of the second embodiment thus serve as movable and stationary contact elements, respectively, of switch means biased toward a closed condition by means of the torsion spring 138 and are illustrated accordingly in FIG. 6.

The weft retaining arrangement incorporated into the second embodiment of the control device according to the present invention is adapted to capture the foremost end portion of the pick of the weft yarn 16 by means of two sets of weft retaining yarns 142 and 142'. The two sets of weft retaining yarns 142 and 142' are drawn off at the same speed as the warp yarns 38 and are alternately raised and lowered by means of a plurality of healds 144 (only one of which is shown) for forming a shed 146 which is similar to the shed 36 of the warp yarns 38. The weft yarn 16 shot through the shed 36 of the warp yarns 38 is also inserted into the shed 146 of the weft retaining yarns 142 and 142', provided the pick of the weft yarn 16 has a proper length which is sufficient to cover the entire widths of the two sheds 36 and 146. The foremost end portion of the weft yarn 16 inserted into the shed 146 of the weft retaining yarns 142 and 142' is woven with the weft retaining yarns into a coarse fabric 148 when the weft yarn 16 is beaten up onto the fell 44 of the woven fabric 46. The coarsely woven fabric 148 serves to retain the foremost end portion of the weft yarn 16 until the weft yarn is cut at the widthwise foremost end of the woven fabric 46 by means of the heat-cutter 72 which is located adjacent the end of the fell 44 of the fabric 46 as illustrated.

Turning to FIG. 6, the second embodiment of the control device according to the present invention comprises an electric control circuit 150 which is constructed similarly to the control circuit illustrated in FIG. 3 but which is void of the logical AND gate circuit incorporated into the control circuit of FIG. 3. The control circuit 150 shown in FIG. 6 thus comprises a logical negation circuit 112 having an input terminal connected through a d.c. power source 114 to the second or stationary contact element 140 of the first detecting means and a control signal generating circuit 118 which has a first input terminal connected to the output terminal of the negation circuit 114 and a second input terminal with the output terminal 100 of the second detecting means previously described with reference to FIG. 2. The control signal generating circuit 118 is arranged in such a manner as to operate similarly to its counterpart incorporated into the control circuit of FIG. 3 and is, thus adapted to produce an output signal when supplied with a predetermined number of logical 1 signals from the negation circuit 112 within a time interval between consecutive two of the pulses delivered from the output terminal 100 of the second detecting means shown in FIG. 3 and to be re-set by the pulse from the second detecting means if supplied from the negation circuit with logical 1 signals less than the predetermined number during the time interval. The signal generating circuit 118 has an output terminal connected through an amplifier 120 to a relay 125 which has a relay coil 126 and a set of normally-closed contacts 128 which are adapted to be made open when the relay coil 126 is energized. The normally-closed contacts 128 are connected between terminals 130 and 132 which lead respectively from, for example, an electrically powered driving unit for the loom and a power source for the driving unit, as previously mentioned with respect to FIG. 3.

The operation of the second embodiment of the control device according to the present invention will now be described with reference mainly to FIGS. 5 and 6. In the absence of the pick of the weft yarn 16 in the shed 36 of the warp yarns 38 and the shed 146 of the weft retaining yarns 142 and 142', the first contact element 134 of the first detecting means shown in FIG. 5 is forced by the torsion spring 138 into its first angular position contacting the second contact element 140, thereby providing electrical connection between the first and second contact elements 134 and 140. The switch means constituted by the first and second contact elements 134 and 140 is thus maintained in closed condition so that the negation circuit 112 is supplied with a current from the d.c. power source 114 and delivers a logical 0 signal to the control signal generating circuit 118. Thus, the control signal generating circuit 118 produces no output signal even though the circuit 118 is periodically supplied with the pulses from the output terminal 100 of the second detecting means shown in FIG. 2. When, however, the weft yarn 16 is shot through the shed 36 of the warp yarns 38 and further through the shed 146 of the weft retaining and yarns 142 and 142' so as to reach the widthwise remotest end of the latter shed 146 and is thereafter beaten up onto the fell 44 of the previously woven fabric 46 by means of the reed 42, then the weft yarn 16 is brought into pressing engagement with the rear end of the lower end portion **134*b* of the first contact element 134 of the first detecting means shown in FIG. 5 and drives the first contact element 134 to rotate about the axis of the shaft 136 from the first angular position into the second angular position against the opposing force of the torsion spring 138. The first contact element 134 is thus disengaged from the second contact element 140 contact elements 134 and 140 is interrupted. When the normally-closed switch means made up of the first and second contact elements 134 and 140 is made open, the negation circuit 112 is disconnected from the d.c. power source 114 and delivers a logical 1 signal to the control signal generating circuit 118 in the circuitry 150 shown in FIG. 6. The pick of the weft yarn 16 is cut at the widthwise foremost end of the fell 44 of the woven fabric 46 by means of the heat-cutter 72 at an instant approximately simultaneously as or immediately before another pick of the weft yarn 16 is beaten up against the fell 44 of the fabric 46 by the reed 42. The first contact element 134 of the first detecting means is constantly maintained in the first angular position contacting the second contact element 140 and thus providing electrical connection between the two contact elements 134 and 140, provided the picks of the weft yarn 16 have the proper length covering the width of the shed 36 of the warp yarns 38 and retained at their foremost ends by the weft retaining yarns 142 and 142' and are properly beaten up one after another onto the fell 44 of the woven fabric 46. In the event, however, the pick of the weft yarn 16 is short of the proper length and thus fails to be captured by the weft retaining yarns 142 and 142', the pick of the weft yarn 16 is unable to maintain the first contact element 134 of the first detecting means in the second angular position thereof even though the weft yarn may be slightly brought into contact with the first contact element 134 when moved against the fell 44 of the fabric 46 by the forward movement of the reed 42. In such an occasion, the first contact element 134 is allowed to rotate from the second angular position into the first angular position thereof by reason of the biasing force which is constantly applied thereto from the torsion spring 138. The first contact element 134 is thus disengaged and spaced rearwardly apart from the second contact element 140 and thereby interrupts the electrical connection which has been established between the two contact elements 134 and 140. The negation circuit 112 in the control circuitry 150 shown in FIG. 6 is consequently disconnected from the d.c. power source 114 and delivers a logical 1 output signal to the control signal generating circuit 118. If the logical 1 signals thus fed to and stored or memorized a predetermined number during a time interval between consecutive two of the pulses delivered to the control signal generating circuit 118 from the output terminal of the second detecting means shown in FIG. 2, then the signal generating circuit 118 produces an output signal and energizes the coil 126 of the relay 124 by the signal amplified by the amplifier 120 so that the normally-closed contacts 128 are made open and consequently the driving unit for the loom is disconnected from the power source and is brought to a full stop. If, however, the logical 1 signals accumulated in the control signal generating circuit 118 are less than the predetermined number during the time interval between the consecutive two of the pulses delivered from the second detecting means, then the signal generating circuit 118 is re-set and accordingly the signal which have been stored in the circuit 118 are cleared in response to the pulse fed from the second detecting means to the signal generating circuit 118** at the end of the above mentioned time interval.

Figure 8:
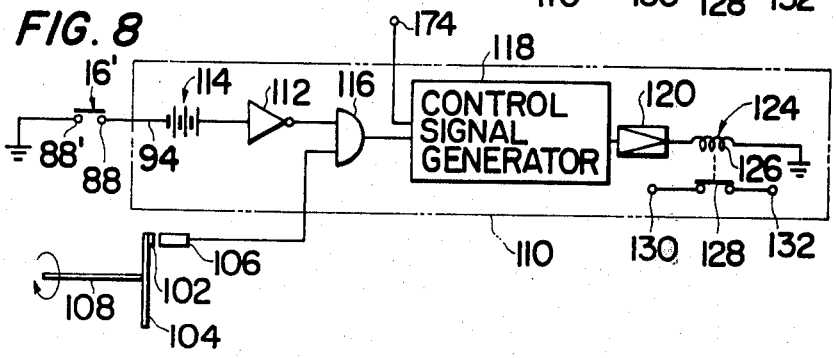
FIG. 8 is a block diagram showing a preferred example of a control circuit to form part of the third embodiment of the control device according to the present invention.
Figure 7:
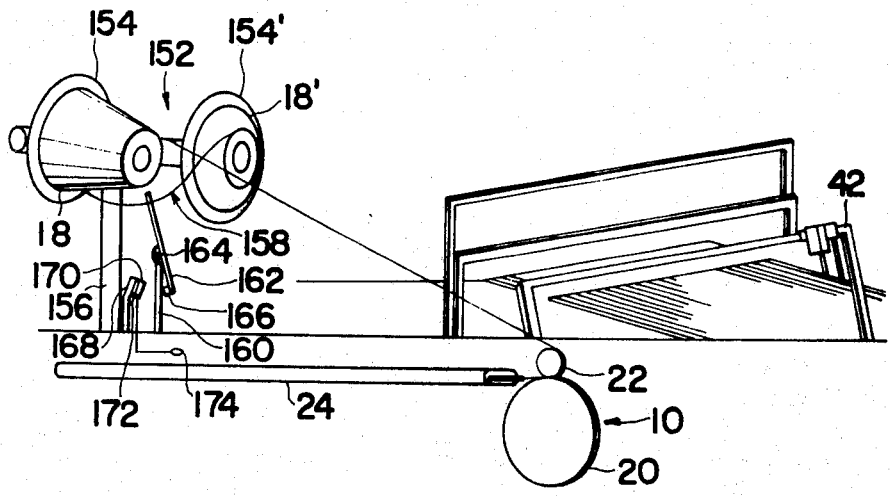
FIG. 7 is a perspective view which shows essential parts and structures constituting a weft supply arrangement and a weft inserting motion of an automatic weaving loom incorporating a third preferred embodiment of the control device according to the present invention.

While the weaving rate of the loom has been assumed to be approximated by the speed at which the woven fabric is drawn from the weaving unit or, more specifically, by the revolution speed of the friction roller 82 forming part of the weaving density control means 80 shown in FIG. 2, the weaving rate may be approximated by the length of the weft yarn drawn off from the yarn supply source or, more specifically, by the number of the yarn supply packages or cones consumed. FIGS. 7 and 8 illustrate an embodiment of the control device which is arranged to include first detecting means of such a nature.

Referring to FIG. 7, the automatic weaving loom to incorporate the third embodiment of the present invention is shown to have a weft yarn supply arrangement 152 in which is disposed a number of yarn supply packages or cones are disposed although only two of them are illustrated as at 18 and 18'. The cones 18 and 18' are formed of continuous yarns having substantially equal lengths each having leading and terminating ends and are carried on respective cone holders 154 and 154' which are supported by a stationary cone stand 156 positioned relative to the weft drawing and measuring means 10. The yarn in one of the cones 18 and 18' has end portion leading to the weaving unit of the loom and is tied at its terminating end to the leading end of the yarn in the other of the cones 18 and 18', forming a knot 158 between the terminating end of the former yarn and the leading end of the latter yarn. In the arrangement illustrated in FIG. 7, the yarn 16 in the cone 18 has its leading end portion connected to the weaving unit of the loom and its terminating end tied as at 158 to the leading end of the yarn in the cone 18'. When, thus, the cone 18 is consumed so that the weft yarn 16 is drawn from the cone 18', the cone holder 154 may be re-loaded with a new cone so that the yarn in the new cone is tied at its leading end to the terminating end of the yarn on the cone 18'. If the two cone holders 154 and 154' are alternately reloaded with new cones and the yarns in the two cones are tied in the above described manner, then only two cone holders 154 and 154' may be provided in the yarn supply arrangement 152 as shown.

In the vicinity of the cone stand 156 is positioned a bracket 160 carrying at its upper end a rockable member 162 through a substantially horizontal pivotal shaft 164. The rockable member 162 is rotatable about an axis of the shaft 164 and is generally in a bar form having aligned arm portions which are separated from each other by the point of the member pivoted to the shaft 164 and which have different lengths. The rockable member 162 is, thus, biased toward an angular position having the longer one of the arm portions directed or inclined downwardly and the shorter one of the arms directed or inclined upwardly by reason of the difference between the weights of the arm portions. The rockable member 162 is, furthermore, positioned relative to the cone holders 154 and 154' in such a manner as to have its longer arm portion engageable with the knot 158 between the yarns in the cones 18 and 18' or an end portion of either of the yarns when the end portions of the yarns adjacent to the knot 158 are in slackened conditions dangling downwardly. The rockable member 162 is rotatable about the axis of the shaft 164 between a first angular position having the longer arm portion directed or inclined downwardly by reason of the differential weights of the arm portions thereof and a second angular position having the longer arm portion raised or turned upwardly about the axis of the shaft 164. When the rockable member 162 is held in the first angular position with no external force applied thereto, the rockable member 162 engages at the lower end of its longer and heavier arm portion with the knot 158 between the yarns in the cones 18 and 18' or an adjacent end portion of either of the yarns if the tied end portions of the two yarns are in slackened or downwardly dangling conditions. When the cone 18 or 18' is on the point of being consumed so that the tied end portions of the yarns in the two cones 18 and 18' are rendered taut and accordingly raised from the downwardly dangling positions, the rockable member 160 engaged at the lower end of its longer arm portion by the end portions of the yarns is rotated about the axis of the shaft 162 into the second angular position thereof with the longer arm portion raised by the upwardly moved end portions of the yarns as illustrated in FIG. 7. To the leading end of the shorter arm portion of the rockable member 160 is secured a first contact element 166 which is grounded through the rockable member 160 and the bracket 168. In the vicinity of the bracket 160 is further positioned a bracket 168 which has fixedly carries at its upper end a second contact element 170 through an insulating element 172. The second contact element 170 is positioned relative to the rockable member 160 in such a manner that the first contact element 166 carried on the rockable member 160 is brought into abutting engagement with the second contact element 170 on the bracket 168 when the rockable member 160 is rotated about the axis of the shaft 164 into the above mentioned second angular position by the end portions of the yarns in the cones 18 and 18' when the end portions of the yarns are made taut. When, thus, one of the cones 18 and 18' is consumed so that the knot 158 and accordingly the adjacent end portions of the yarns in the cones 18 and 18' are moved upwardly, the rockable member 160 which has been held in the first angular position thereof with the end portions of the yarns in downwardly dangling conditions is moved into the second angular position bringing the first contact element 166 into abutting engagement with the second contact element 170 and provides electrical connection between the first and second contact elements 166 and 170. The second contact element 170 is connected to a lead having an output terminal 174 which is, in turn, connected through a d.c. power source 114 to a control circuitry 110 which is, in itself, constructed and arranged entirely similarly to the control circuit illustrated in FIG. 3 except for the fact that the control signal generating circuit 118 is connected at one of its input terminals to the output terminal 174 of the detecting means shown in FIG. 7, not the output terminal 100 of the detecting means illustrated in FIG. 1. The description regarding the construction and arrangement of the control circuit shown in FIG. 3 thus applies as it is to the control circuit illustrated in FIG. 8 and, for this reason, will not be herein repeated.

While the detecting means shown in FIG. 1 is adapted to produce a pulse representative of the end of a predetermined length of the woven fabric each time the friction roller 82 (see FIG. 1) is rotated a full turn, the detecting means arranged as illustrated in FIG. 7 is adapted to produce such a pulse each time the cone 18 or 18' connected to the weaving unit of the loom is used up. Since, in this instance, all the cones to be mounted on the cone holders 154 and 154' during a single operation are prepared so as to contain yarns having substantially equal predetermined lengths, pulses will appear at the output terminal 174 at time intervals which are indicative of corresponding unit lengths of the continuous weft yarn drawn off from the yarn supply arrangement 152. These pulses may be produced in accordance with the operation speed or the operation period of the loom so that each of the pulses is produced at an interval when a predetermined length of a fabric is produced. The pulse signals supplied to the control signal generating circuit 118 are, for this reason, essentially similar in pulse repetition frequency to the pulse signal supplied from the detecting means previously described with reference to FIG. 1.

Figure 9:
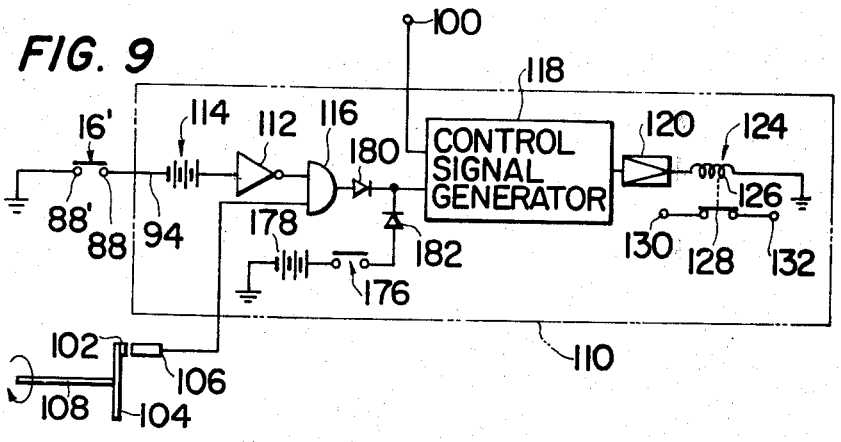
FIG. 9 is a block diagram which shows another preferred example of the control circuit which may be incorporated in the embodiment of the control device according to the present invention, especially in the embodiment shown in FIGS. 1 or 5 although the circuit may be readily modified to be adaptable to the embodiment illustrated in FIG. 7.

In each of the embodiments of the control device according to the invention as thus far described, the signals which have been stored or memorized in the control signal generating circuit 118 are cleared and accordingly the signal generating circuit 118 is reset when the circuit 118 produces an output signal and stops the loom. A logical 1 signal which may be fed to the signal generating circuit in a succeeding or re-opened operation of the loom is, therefore, counted as the first new signal by the signal generating circuit 118. Because, however, the loom or, more specifically, the weft inserting motion of the loom tends to fail to properly operate more frequently than usual, viz., than in the preceding operation of the loom, it is preferable that the loom be stopped for a second time in response to the first improper pick of the weft yarn during the re-opened operation of the loom, as previously noted. FIG. 9 shows a control circuitry which is adapted to achieve such an end.

Referring to FIG. 9, the control circuitry, designated in its entirety by reference numeral 110', is shown as being a modification of the control circuitry 10 shown in FIG. 3 and consists of all the component circuits making up the circuitry illustrated in FIG. 3. The control circuitry 110' shown in FIG. 9 comprises, in addition to the component circuits illustrated in FIG. 3 a normally-open switch 176 which is connected between a d.c. power source 178 and one of the input terminals of the signal generating circuit 118 in parallel with the logical AND gate circuit 116, the other input terminal of the signal generating circuit 118 being connected to the output terminal 100 of the detecting means shown in FIG. 1. Between the AND gate circuit 116 and the signal generating circuit 118 is connected a diode 180 and, between the switch 176 and the signal generating circuit 118 is likewise connected a diode 182. Both of the diodes 180 and 182 have their cathode terminals directed toward the input terminal of the signal generating circuit 118 so as to prevent flows of current in reverse directions.

The switch 176 may be of the type which is manually operated or which may be automatically actuated in response to the delivery of the output signal from the signal generating circuit 118, to the actuation of the relay 124, or to the stoppage or re-start of the loom. Inwhichsoever fashion the switch 176 may be arranged, the switch 176 is closed a predetermined number of times after the signal generating circuit 118 has been re-set so that the particular number of signals are stored or memorized in the signal generating circuit 118 before the circuit 118 is supplied with the first new signal from the AND gate circuit 116 during operation of the loom which is re-started upon completion of the servicing of the weft inserting motion. The number of times the switch 176 is to be closed before re-starting of the loom should therefore be smaller by one than the number of signals by which the signal generating circuit 118 is caused to produce an output signal during the time interval between consecutive two of the pulses from the output terminal 100 of the detecting means responsive to the weaving rate of the loom. If, for example, the signal generating circuit 118 is so arranged as to produce an output signal in response to three signals from the AND gate circuit 116 during one time interval between two consecutive pulses from the output terminal 100, then the switch 176 should be closed twice before the loom is re-started after removal of a failure involved in the weft inserting motion of the loom. While the switching arrangement of the above described nature has been assumed in FIG. 9 as being incorporated into the control circuitry constructed as shown in FIG. 3, it is apparent that such a switching arrangement may be incorporated into the control circuitry illustrated in FIGS. 6 or 8 if desired.

Having thus far described a few preferred embodiments of the control device according to the present invention, it should be borne in mind that such embodiments are merely for the purpose of illustration and may therefore be modified in numerous manners where desired. While, for example, the embodiments of the device according to the present invention have been described and shown as being incorporated into the automatic weaving looms of the shuttleless design, such is merely by way of example and, thus, the present invention may be applied to any of other types of looms such as the looms using shuttles. In this instance, the detecting means for detecting improper picks of the weft yarn into the shed may be constituted by or associated with a weft fork, such as a center or side fork, of the loom because the weft fork is, as is well known in the art, operative to respond to breakage or running-out of the weft yarn.

What is claimed is:

1. A method of controlling a weft inserting motion of a weaving loom for stopping the loom in response to failure in the weft inserting motion, comprising the steps of:

monitoring the operation of the loom and producing a train of first signals at time intervals each representative of a predetermined length of a fabric produced;

monitoring picks of a weft yarn shot into a shed of warp yarns and producing a second signal responsive to a pick of the weft yarn improperly shot into the shed;

storing the second signals produced;

producing a control signal responsive to a predetermined number of the second signals produced within a time interval between consecutive two of the first signals for stopping the loom;

clearing the stored second signals if the stored second signals are short of said predetermined number at the end of said time interval; and developing and storing a predetermined number of third signals prior to re-starting of the loom, said predetermined number of the third signals being smaller by at least one than said predetermined number of said second signals, thereby to produce said control signal in response to the second signal firstly produced in a subsequent operation of the loom which is re-started.

2. A method according to claim 1, in which said first signal is produced in response to the travel of the woven fabric which has been drawn off over a predetermined distance from the fell of the fabric.

3. A method according to claim 1, in which said first signal is produced in response to a predetermined length of the weft yarn drawn off from a yarn supply package.

4. A method according to claim 1, in which said second signal is produced by detecting picking cycles of the weft yarn into the shed for producing fourth signals representative of timings at which the weft yarn is cyclically shot into the shed, and detecting an improper pick of the weft yarn and producing a fifth signal in response to the improper pick so that said second signals are produced when said fourth and fifth signals are produced concurrently.

5. A method according to claim 1, in which said second signal is produced by detecting a pick of the weft yarn improperly shot into the shed and beaten up onto the fell of the fabric in a non-tensioned condition.

6. A device for controlling a weft inserting motion of a loom for stopping the loom in response to failure in the weft inserting loom, comprising:

first monitoring means for monitoring the operation of the loom for producing a train of pulses at time intervals each representative of a predetermined unit length of a fabric produced;

second monitoring means for monitoring picks of a weft yarn into a shed of warp yarns for producing a first signal responsive to a pick of the weft yarn improperly shot into the shed;

a control circuitry to be supplied with said pulses and said first signal for storing the first signals produced by said second monitoring means and producing a control signal responsive to a predetermined number of the first signals stored within a time interval between consecutive two of said pulses, means in said control circuitry re-set by the pulse from said first monitoring means if said first signals stored in said control circuitry are short of said predetermined number;

first means operative to stop the loom in response to said control signal; and second means for producing and storing a predetermined number of second signals prior to re-starting of the loom in said control circuitry, said predetermined number of the second signals being smaller by at least one than said predetermined number of the first signals, whereby said first means stops the loom in response to said control signal firstly produced in a subsequent operation of the loom which is restarted.

7. A device according to claim 6, in which said first monitoring means comprises detecting means operative to detect the travel of the woven fabric away from the fell of the fabric for producing said first signal each time the woven fabric has travelled a predetermined distance from said fell of the fabric.

8. A device according to claim 6, in which said first monitoring means comprises detecting means operative to detect the drawing-off rate of the weft yarn from a yarn supply source for producing said first signal each time the weft yarn is drawn a predetermined length from said yarn supply source.

9. A device according to claim 8, in which said yarn supply source consists of at least two yarn supply packages containing substantially equal lengths of weft yarns, one of the yarns having a leading end drawn into said weft inserting motion and a terminating end having a knot tied to the leading end of the other yarn, and in which said detecting means comprises a rockable member which is rockable between a first angular position engageable with either of joined end portions of the yarns in said packages and a second angular position which is raised from said first angular position by the joined end portions of the yarns when the joined end portions are rendered taut and moved upwardly with one of the yarn supply packages on the point of being consumed, a first contact element movable with said rockable member, and a second contact element with which said first contact element engageable when said rockable member is in said second angular position for providing electrical connection between the first and second contact elements and thereby producing said pulse each time the rockable member is moved into the second angular position thereof in response to the condition in which one of said yarn supply packages is about to be consumed.

10. A device according to claim 6, in which said second monitoring means comprise detecting means for detecting picking cycles of the weft yarn into the shed for producing third signals representative of timings at which the weft yarn is cyclically shot into the shed and detecting means for detecting an improper pick of the weft yarn into the shed for producing a fourth signal in response to the improper pick for producing said first signal from said second monitoring means when said third and said fourth signals are produced concurrently from both of said detecting means.

11. A device according to claim 6, in which said control circuitry comprises a logical negation circuit for being supplied with said first signal from said second monitoring means, and a control signal generating circuit having a first input terminal for being supplied with said pulses from said first monitoring means and a second input terminal connected to the output terminal of said logical negation circuit, said signal generating circuit being operative to store therein the signals from said negation circuit for producing said control signal when the stored signals reach said predetermined number within said time interval and being re-set by the pulse fed from said first monitoring means at the end of said time interval if the signals stored in the signal generating circuit are short of said predetermined number during said time interval.

12. A device according to claim 11, in which said second monitoring means comprises first detecting means for detecting picking cycles of the weft yarn into the shed of the warp yarns for producing signals representative of the timings at which the weft yarn is cyclically shot into the shed, said first detecting means having an output terminal connected to the input terminal of said negation circuit, and second detecting means for detecting an improper pick of the weft yarn for producing a signal in response to the improper pick, and in which said control circuitry further comprises a logical AND gate circuit having a first input terminal connected to the output terminal of said negation circuit, a second input terminal connected to the output terminal of said second detecting means, and an output terminal connected to said first input terminal of said control signal generating circuit.

13. A device according to claim 11, in which said second means is switching means connected to said first input terminal of said control signal generating circuit and operative to be closed the predetermined number of said second signals after the control signal generating circuit has been re-set and prior to restarting of the loom, said predetermined number of said second signals being smaller by at least one than the predetermined number of said first signals with which the signal generating circuit produces said control signal during the time interval between consecutive two of said pulses from said first monitoring means.

* * * * *